US005556101A

United States Patent [19]

Jabro

[11] Patent Number: 5,556,101

[45] Date of Patent: Sep. 17, 1996

[54] DICE BETTING GAME AND METHOD FOR PLAYING

[76] Inventor: Sarmad S. Jabro, 5424 High Court Way, West Bloomfield, Mich. 48323

[21] Appl. No.: 452,972

[22] Filed: May 30, 1995

[51] Int. Cl.[6] ..... A63F 9/04

[52] U.S. Cl. ..... 273/274; 273/145 E; 273/309

[58] Field of Search ..... 273/146, 145 E, 273/274, 292, 309

[56] References Cited

U.S. PATENT DOCUMENTS

| | | | |
|---|---|---|---|
| 1,036,591 | 8/1912 | Eliscu | 273/145 E |
| 4,921,249 | 5/1990 | Kropkowski et al. | 273/256 |
| 5,413,351 | 5/1995 | Franklin | 273/274 |

FOREIGN PATENT DOCUMENTS

| | | | |
|---|---|---|---|
| 807962 | 10/1936 | France | 273/145 E |

*Primary Examiner*—Benjamin H. Layno
*Attorney, Agent, or Firm*—C. J. Fildes & Co.

[57] ABSTRACT

A betting game employing a first pair of dice or their equivalent for producing a random first set of numbers S1 is disclosed. The betting game includes a playing surface, at least one player station including a first betting zone and a second betting zone. The first betting zone includes an indicia marked on the playing surface representing a second numerical set S2 corresponding to the total of the first pair of dice and the second betting zone includes an indicia marked on the playing surface representing a third numerical set S3 mutually exclusive of the second set S2 and corresponding to the total of the first pair of dice. The betting game includes a dealer station having a first dice spinner for spinning the first pair of dice.

11 Claims, 3 Drawing Sheets

DICE BETTING GAME AND METHOD FOR PLAYING

FIELD OF THE INVENTION

This invention relates to betting games, and, more particularly, betting games employing at least one pair of dice.

BACKGROUND OF THE INVENTION

With the opening of gambling casinos throughout the United States, there has been an increased interest in casino type games. One prior art dice betting game is craps. Craps is a game in which one or more players bet on the outcome or total of the pair of dice thrown by another player. However, only experienced gamblers tend to play craps, since craps is a fairly difficult game to learn, understand and play.

Several dice games are taught in the prior art. For example, U.S. Pat. No. 2,577,087 to Meeks teaches a dice betting game which includes a shaker for shaking the dice. The game includes only one such dice shaker and the dice shaker does not spin to shake or rotate the dice, but instead moves in a side to side fashion. In U.S. Pat. No. 4,921,249 to Kropkowski et al., a dice betting game including a playing surface having an under seven indicia and over seven indicia and a seven indicia is disclosed. To play the game a player places a bet on either the under seven, over seven, or seven indicia. The player then shakes a dice shaker and reads the number of spots on the face of the dice to determine if the total of the dice is either seven, over seven, or under seven. The player is declared a winner if a match occurs between the total of the dice and the bet the player placed. That is, either on the total of the dice being seven, over seven, or under seven. Again, only one shaker is employed to play the game. The shaker shakes the dice by moving the dice in an up and down fashion, rather than spinning the dice by utilizing a dice spinner.

SUMMARY OF THE INVENTION

The present invention provides a betting game employing at least one pair of dice and at least one dice spinner. It provides a betting game with all the excitement and player involvement of craps but which is simpler to play, use and understand.

More specifically, a betting game employing a first pair of dice or their equivalent for producing a random first set of numbers S1 includes a playing surface and at least one player station including a first betting zone and a second betting zone. The first betting zone includes an indicia marked on the playing surface representing a second numerical set S2 corresponding to the total of the first pair of dice. The second betting zone includes an indicia marked on the playing surface representing a third numerical set S3 mutually exclusive of the second numerical set S2 and corresponding to the total of the first pair of dice. The betting game includes a dealer station having a first dice spinner for spinning the first pair of dice.

In one embodiment of the invention each of the player stations include a third betting zone having an indicia marked on the playing surface representing a fifth numerical set S5 mutually exclusive of the second and third numerical sets S2, S3 and corresponding to the total of the first pair of dice. In this embodiment the second numerical set S2 is all numbers greater than seven, the third numerical set S3 is all numbers less than seven, and the fifth numerical set S5 is the number seven.

In another embodiment of the invention, at least one of the player stations include a second dice spinner for spinning a second pair of dice or their equivalent for producing a random forth set of numbers S4. In this embodiment the second numerical set S2 is all numbers greater than the total of the first pair of dice and the third numerical set S3 is all numbers equal to the total of the first pair of dice. This embodiment may also include a third betting zone having indicia marked on the playing surface representing a fifth numerical set S5 mutually exclusive of the second and third numerical sets S2, S3 and corresponding to the total of the first pair of dice. If a third betting zone is included with this embodiment then the fifth numerical set S5 is all numbers less than the total of the first pair of dice.

In yet another embodiment of the invention each player station includes a dice spinner in addition to the dice spinner devoted to the dealer station.

The present invention also includes a method for playing a betting game. The method includes the steps of providing a playing surface, providing a first pair of dice for producing a random first set of numbers S1, and providing a player station having a first betting zone and a second betting zone. The first betting zone has indicia marked on the playing surface representing a second numerical set S2 corresponding to the total of the first pair of dice and the second betting zone has indicia marked on the playing surface representing a third numerical set S3 mutually exclusive of the second numerical set S2 and corresponding to the total of the first pair of dice. This method also includes the steps of providing a second pair of dice for producing a random fourth set of numbers S4, placing at least one bet on the first or second betting zone, rolling the first pair of dice and determining the total thereof, rolling the second pair of dice and determining the total thereof, comparing the totals of the first and second pair of dice to determine whether the total of the second pair of dice falls within either the second or third numerical sets S2, S3 and declaring bets placed on the first betting zone winners if the total of the second pair of dice falls within the second numerical set S2.

The method according to the present invention may also include the steps of providing a third betting zone for the player station having an indicia marked on the playing surface representing a fifth numerical set S5 mutually exclusive of the second and third numerical sets S2, S3 and corresponding to the total of the first pair of dice, placing a bet on the third betting zone, comparing the totals of the first and second pair of dice to determine whether the total of the second pair of dice falls within the fifth numerical set S5, and declaring bets placed on the third betting zone winners if the total of the second pair of dice falls within the fifth numerical set S5.

These and other features and advantages of the invention will be more fully understood from the following detailed description of the invention taken together with the accompanying drawings.

DETAILED DESCRIPTION OF THE INVENTION

Figure 1:
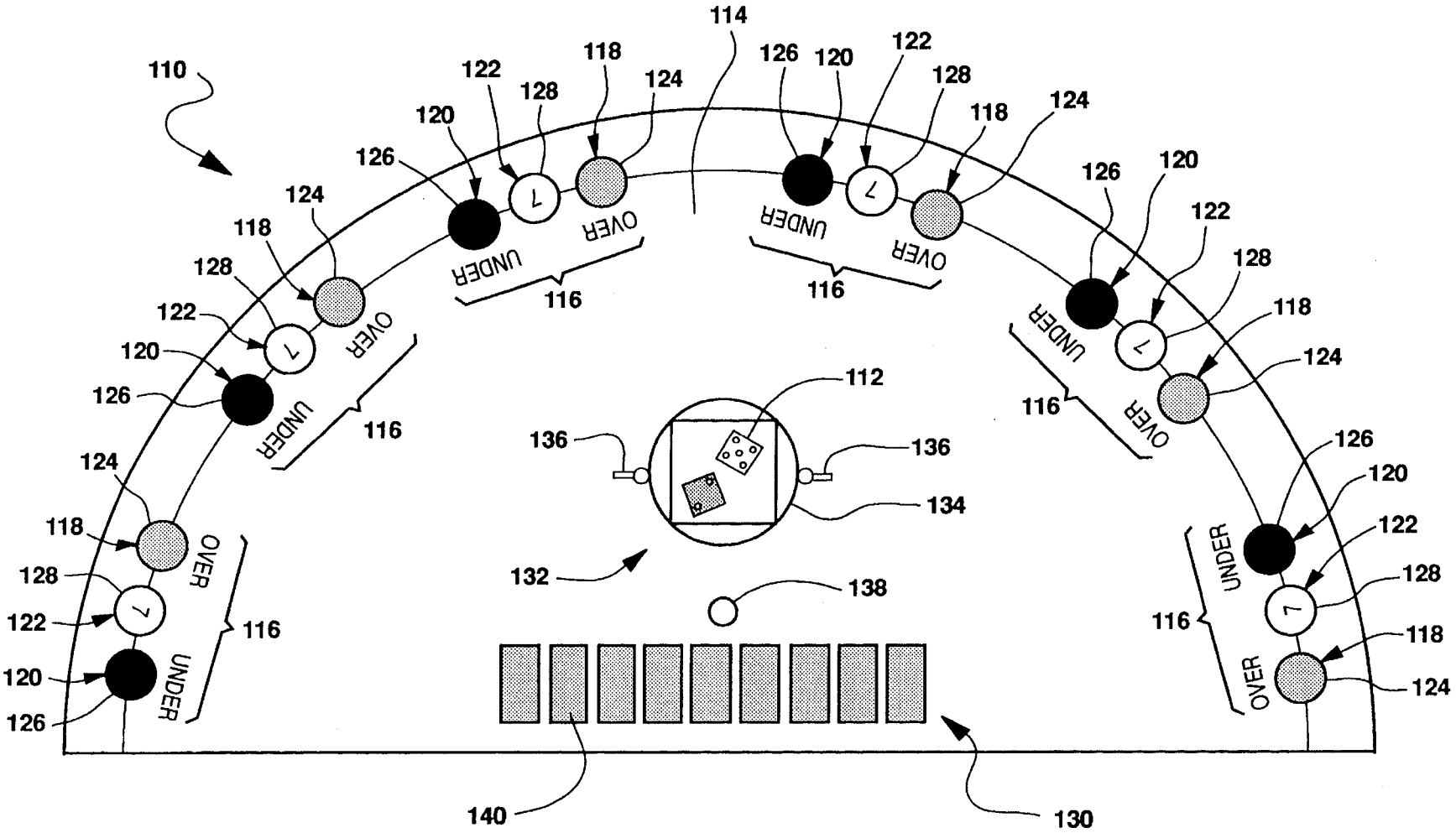
FIG. 1 is a top plan view of a betting game according to the present invention showing a dice spinner located at the dealer station.
Figure 2:
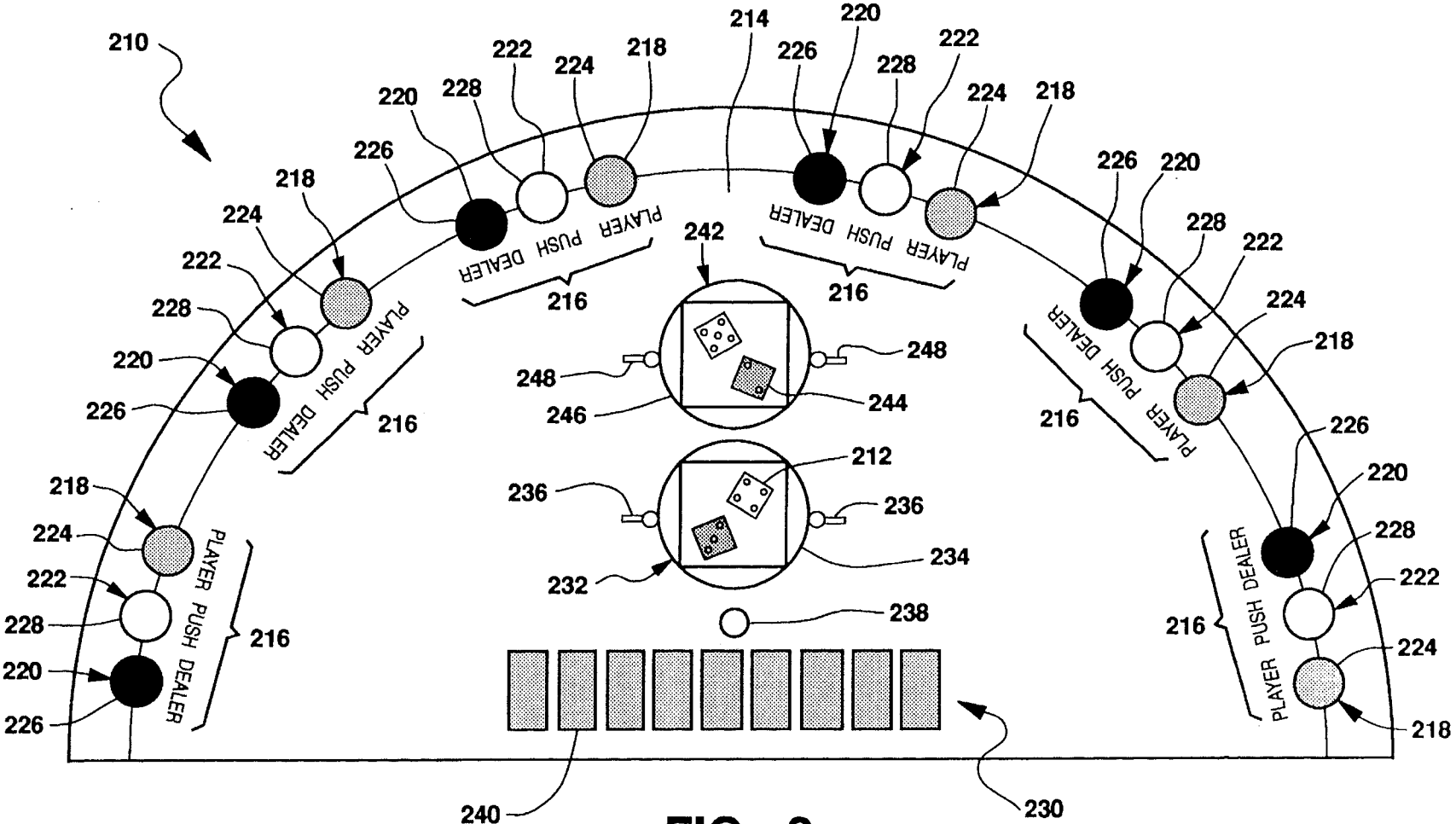
FIG. 2 is a top plan view of another embodiment of betting game according to the present invention showing a first dice spinner located at the dealer station and a second dice spinner located at one of the player stations.
Figure 3:
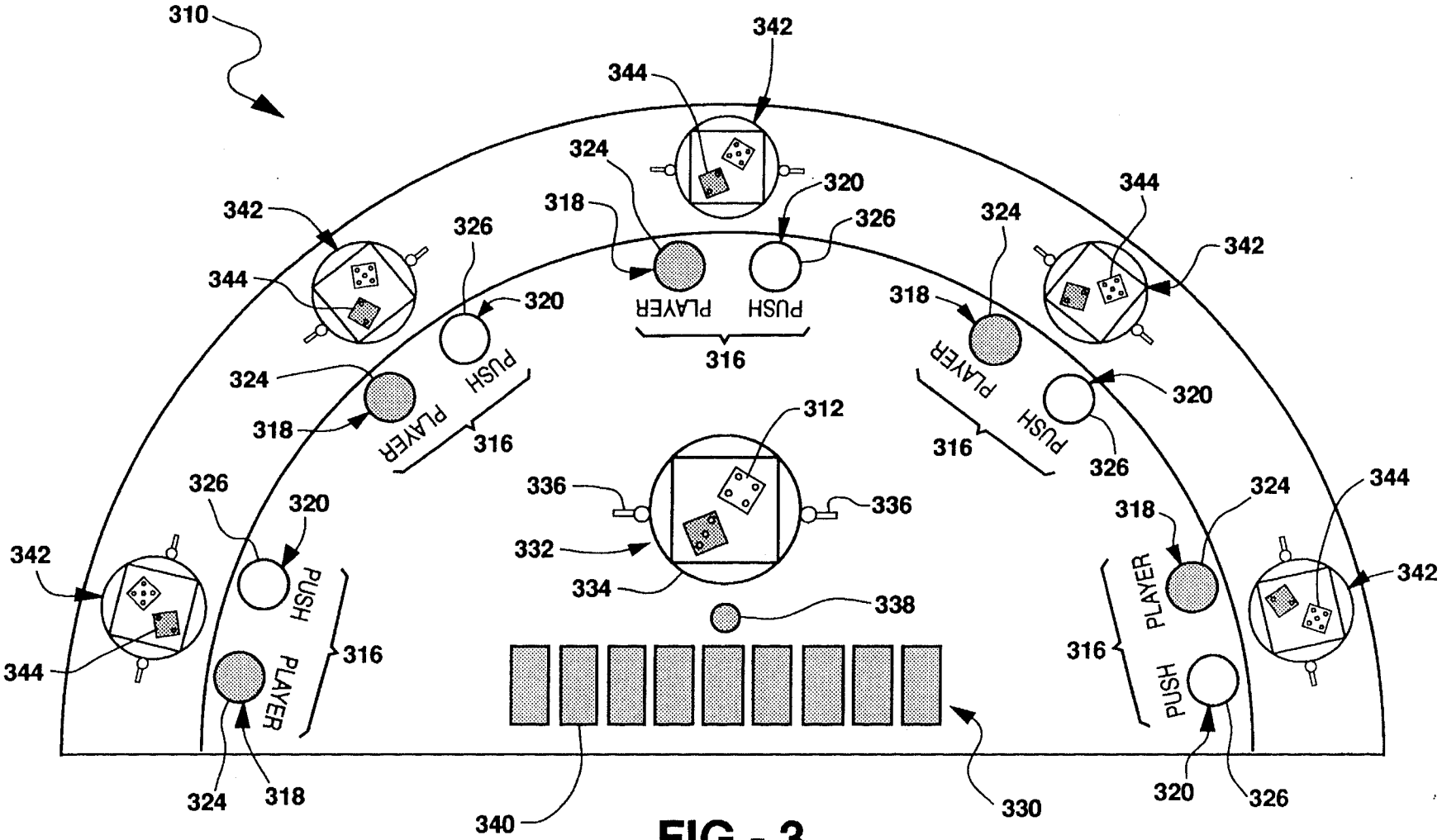
FIG. 3 is a top perspective view of another embodiment of betting game according to the present invention showing a first dice spinner located at the dealer station and multiple dice spinners at each player station.

Referring now to FIGS. 1–3 there are shown various betting game embodiments according to the invention. Because some of the details of these betting game embodiments have similar components or parts, similarly ending numerals are used for like or similar parts.

One embodiment of betting game according to the invention as shown in FIG. 1 and is generally indicated by numeral 110. This embodiment of the betting game will be hereinafter referred to as OVER AND UNDER. OVER AND UNDER employs the first pair of dice 112 for producing a random first set of numbers S1. The first set of numbers S1 may include any one of the numbers from two through twelve. It will be appreciated that the mechanized or electronic equivalents may be used to replace the first pair of dice 112 in producing the random first set of numbers S1. OVER AND UNDER includes a playing surface 114 and at least one player station 116. Each player station includes a first betting zone 118 and a second betting zone 120. OVER AND UNDER 110 may also include a third betting zone 122. The first betting zone 118 includes an indicia 124 marked on the playing surface 114 representing a second numerical set S2 corresponding to the total of the first pair of dice 112. The second betting zone 120 includes an indicia 126 marked on the playing surface 114 representing a third numerical set S3 mutually exclusive of the second numerical set S2 and corresponding to the total of the first pair of dice 112. The third betting zone 122 includes an indicia 128 marked on the playing surface 114 representing a fifth numerical set S5 mutually exclusive of the second and third numerical sets S2, S3 and corresponding to the total of the first pair of dice 112.

OVER AND UNDER 110 further includes a dealer station 130. The dealer station 130 includes a first dice spinner 132 for spinning the first pair of dice 112, First dice spinner 132 includes a container 134 for containing the first pair of dice 112 and support members 136 operably associated with the container 134 for supporting the container in an elevated position above the playing surface 114. The container 134 is rotatably supported by the support members 136 that act as bearings so that the container may be rotated on a horizontal axis between the members 136, as shown. Actuator 138 may be provided for rotating the container 134 by any suitable means such as an electric motor or mechanical drive.

In the betting game of OVER AND UNDER 110 second numerical set S2 is all numbers greater than seven. The third numerical set S3 is all numbers less than seven, and the fifth numerical set S5 is the number seven. OVER AND UNDER 110 may also include a tray 140 for holding money or betting chips. The tray 140 may be positioned at the dealer station 130.

The OVER AND UNDER game 110 is played in the following manner. First, each player places a bet on either the first 118, second 120, or third 122 betting zones, by placing money, betting chips or other money equivalents over either the over indicia 124, the under indicia 126 or the seven indicia 128 on the playing surface 114. After each player has placed their bet, the dealer spins the dice 112 using the dice spinner 132. After the dice 112 have come to rest, the total of the dice is determined. If the total of the dice 112 is over seven then those players with bets on the over indicia 124 are declared winners, while those players having bets on the under seven indicia 126 or the seven indicia 128 are declared losers. Similarly, if the total of the dice 112 is under seven those players having bets on the under seven indicia 126 are declared winners, while those having bets on the seven indicia 128 or the over indicia 124 are declared losers. Finally, if the total of the dice 112 equals seven then those players placing bets on the seven indicia 128 are declared winners while those players placing bets on the over indicia 124 or the under indicia 126 are declared losers. The payouts for the winning players may be varied. For example, players winning by placing their bets on the seven indicia 128 may be paid double relative to those players winning by placing their bets on either the over indicia 124 or the under indicia 126.

Referring now to FIG. 2, another embodiment of betting game according to the invention is shown and generally indicated by numeral 210. Betting game 210 is hereinafter referred to as CHOICE. In the betting game CHOICE 210, a second dice spinner 242 is provided for one of the player stations 216 whereas the first dice spinner 232 is devoted to the dealer station 230. The second dice spinner 242 is used to spin a second pair of dice 244 for producing a random fourth set of numbers S4. The random set of numbers S4 is any one of the numbers from two through twelve. Again, although dice 244 and spinner 242 are preferred, any other mechanized or electronic equivalent for producing the fourth set of numbers S4 may be used within the scope of the invention.

The second spinner 242 includes a container 246 and support members 248 operably associated with the container 246. The container 246 is rotatably supported by the support members 248 so that the container may be rotated via physical contact by a player or by mechanized or electronic actuation. In the betting game CHOICE 210, the second numerical set S2 is all numbers greater than the total of the first pair of dice 212, the third numerical set S3 is all numbers equal to the total of the first pair of dice 212 and the fifth numerical set S5 is all numbers less than the total of the first pair of dice 212.

The game of CHOICE 210 is played in the following manner. First, each player places a bet on either the first 218, second 220 or third 222 betting zones by placing money, betting chips or other money equivalents on the indicia 224, 226 or 228 on the playing surface 214 respectively. Next, the dealer spins the first pair of dice 212 using the first dealer spinner 232. After the first pair of dice 212 have come to rest the total of the dice 212 is determined. Next, one of the players spins the second pair of dice 244 by using the player or second spinner 242. After the second pair of dice 242 have come to rest the total of the second pair of dice is determined. If the total of the second pair dice 244 is greater than the total of the first pair of dice 212 then those players placing bets on the player indicia 224 are declared winners, while those players placing bets on the dealer or push indicia 226, 228 are declared losers.

In a similar fashion, if the total of the first pair of dice 212 is greater than the total of the second pair of dice 244 then those players placing bets on the dealer indicia 226 are declared winners, while those players placing bets on either the player or push indicia 224, 228 are declared losers. Finally, if the total of the first pair of dice 212 is equal to the total of the second pair of dice 244 then those players placing bets on the push indicia 228 are declared winners, while those players placing bets on either the player or dealer indicia 224, 226 are declared losers. The payout to the winners may be varied as in the betting game OVER AND UNDER 110. For example, those players who win by placing a bet on the push indicia 228 may be paid double relative to those winners who place bets on either the player or dealer indicia 224, 226.

Referring now to FIG. 3, another embodiment of betting game according to the present invention is shown and is indicated by numeral 310. Betting game 310 is hereinafter referred to as BEAT THE DEALER. The betting game BEAT THE DEALER 310 includes a dice spinner 342 for each player station 316. As is shown in FIG. 3, there are a total of six dice spinners, one dice spinner 332 devoted to the dealer station 330 and five player dice spinners 342 corresponding to each player station 316.

The betting game of BEAT THE DEALER 310 is played in the following manner. First, each player places a bet on the first 318 or second 320 betting zones. Next, the dealer spins the first pair of dice 312 by using the dealer dice spinner 332. After the first pair of dice 312 come to rest, the total of the first pair of dice 312 is determined. Next, each player operates his or her dice spinner 342 to spin and shake their dice 344. After the dice 344 come to rest, each player determines the total of the dice 344. If the total of the players dice 344 is greater than the total of the dealers dice 312 and the player placed a bet on the player indicia 324 then the player is declared a winner. If, on the other hand, the player placed his bet on the push indicia 326 then the player would be declared a loser. If the total of the players dice 344 is equal to the total of the dealers dice 312 and the player placed his bet on the push indicia 326 then the player is declared a winner. If, on the other hand, the player placed his bet on the player indicia 324 then the player would be declared a loser. The payout for the winners may be varied. For example, those winning bets placed on the push indicia 326 may be paid double relative to those winning bets placed on the player indicia 324.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A betting game employing a first pair of dice or their equivalent for producing a random first set of numbers S1 including:

a playing surface;

at least one player station including a first betting zone and a second betting zone;

said first betting zone including an indicia marked on said playing surface representing a second numerical set S2 corresponding to the total of the first pair of dice;

said second betting zone including an indicia marked on said playing surface representing a third numerical set S3 mutually exclusive of said second numerical set S2 and corresponding to the total of the first pair of dice; and characterized by:

a dealer station including a first dice spinner for spinning the first pair of dice; and at least one of said player stations including a second dice spinner whereby said second dice spinner spins a second pair of dice or their equivalent for producing a random fourth set of numbers S4.

2. The betting game as in claim 1 characterized in that:

said second numerical set S2 is all numbers greater than the total of the first pair of dice.

3. The betting game as in claim 2 characterized in that:

said third numerical set S3 is all numbers equal to the total of the first pair of dice.

4. The betting game apparatus as in claim 3 characterized in that:

each of said player stations include a third betting zone having indicia marked on said playing surface representing a fifth numerical set S5 mutually exclusive of said second and third numerical sets S2, S3 and corresponding to the total of the first pair of dice.

5. The betting game as in claim 4 characterized in that:

said fifth numerical set S5 is all numbers less than the total of the first pair of dice.

6. A method for playing a betting game including the steps of:

providing a playing surface;

providing a first pair of dice for producing a random first set of numbers S1;

providing a player station having a first betting zone and a second betting zone, the first betting zone having indicia marked on the playing surface representing a second numerical set S2 corresponding to the total of the first pair of dice, the second betting zone having an indicia marked on the playing surface representing a third numerical set S3 mutually exclusive of the second numerical set S2 and corresponding to the total of the first pair of dice;

providing a second pair of dice for producing a random fourth set of numbers S4;

placing at least one bet on the first or second betting zone;

rolling the first pair of dice and determining the total thereof;

rolling the second pair of dice and determining the total thereof;

comparing the totals of the first and second pair of dice to determine whether the total of the second pair of dice falls within either the second or third numerical sets S2, S3; and declaring bets placed on the first betting zone winners if the total of the second pair of dice falls within the second numerical set S2.

7. The method as in claim 6 characterized by declaring bets placed on the second betting zone winners if the total of the second pair of dice falls within the third numerical set S3.

8. The method as in claim 7 characterized by providing a third betting zone for the player station having an indicia marked on the playing surface representing a fifth numerical set S5 mutually exclusive of the second and third numerical sets S2, S3 and corresponding to the total of the first pair of dice.

9. The method as in claim 8 characterized by placing a bet on the third betting zone.

10. The method as in claim 9 characterized by comparing the totals of the first and second pair of dice to determine whether the total of the second pair of dice falls within the fifth numerical set S5.

11. The method as in claim 10 characterized by declaring bets placed on the third betting zone winners if the total of the second pair of dice falls within the fifth numerical set S5.

* * * * *